United States Patent [19]

Gillum, Jr.

[11] Patent Number: 4,770,115

[45] Date of Patent: Sep. 13, 1988

[54] LINE GUIDE FOR COPY STAND

[76] Inventor: Richard R. Gillum, Jr., 1002 Lake St., Marblehead, Ohio 43440

[21] Appl. No.: 31,656

[22] Filed: Mar. 30, 1987

[51] Int. Cl.[4] ..... B41J 11/64

[52] U.S. Cl. ..... 116/235; 40/354

[58] Field of Search ..... 40/352–357; 116/235, 236, 240; 33/445, 446, 447

[56] References Cited

U.S. PATENT DOCUMENTS

| | | | |
|---|---|---|---|
| 469,658 | 2/1892 | Chapman | 40/354 |
| 678,541 | 7/1901 | Coffey | 40/354 |
| 679,386 | 7/1901 | Lawton | 40/354 |
| 1,073,939 | 7/1913 | Spedden | 116/240 |
| 1,800,071 | 4/1931 | Hevenor | 40/356 |
| 2,217,127 | 10/1940 | Metcalf | 40/354 |
| 2,642,841 | 6/1953 | Funk | 40/354 |
| 3,332,399 | 7/1967 | Patrick et al. | 40/354 |

FOREIGN PATENT DOCUMENTS

| | | | |
|---|---|---|---|
| 880722 | 4/1943 | France | 40/354 |
| 1390317 | 1/1964 | France | 40/354 |
| 8076 | of 1888 | United Kingdom | 40/354 |

*Primary Examiner*—William A. Cuchlinski Jr.
*Assistant Examiner*—Patrick R. Scanlon
*Attorney, Agent, or Firm*—Pearne, Gordon, McCoy & Granger

[57] ABSTRACT

An indexing line guide for a copy stand having an upright pallet for supporting sheets with horizontal lines of text to be copied. The pallet has a guide rail along one side edge, the rail having a row of rack teeth on the rearward side. A slide is received on and secured to the rail for longitudinal movement, the slide including a line guide that extends over and parallel to the lines of text on the sheet. The slide has an escapement that cooperates with the rack teeth as the guide rail and which is actuated by a lever adapted to be tapped by the user. When the lever is actuated, a pair of teeth in the escapement reverse their relation to the rack teeth momentarily and then reengage the rack teeth at the next lower position. With this operation, the line guide is repositioned immediately below the next line of text on the sheet to be copied.

6 Claims, 4 Drawing Sheets

LINE GUIDE FOR COPY STAND

BACKGROUND OF THE INVENTION

This invention relates to line guides for copy stands such as are used in word processing by a typist or operator to support a sheet or sheets of copy with horizontal lines of text. More particularly, the invention relates to a line guide that may be indexed by the typist or operator, line by line, down the sheet in increments that reflect the vertical spacing between lines of text, and especially to an operating mechanism that eliminates the need for the operator or typist to carefully adjust the line guide to the next lower line by careful visual positioning.

Typists using word processor typers, computer terminals, etc., often support printed copy to be typed on a copy board or stand. The stand generally has an upright tilted surface on which the sheets of copy are placed and often clamped at a convenient position for the operator. Often, the operator will use a horizontal line guide that may be placed below a line of printed text to be typed. This provides a convenient reference as the operator's eyes move back and forth between the copy material and the computer screen or typewritten product.

The line guide, of course, must be repositioned to the next lower line every time the operator completes a line. Usually, this requires manual repositioning of the line guide, which is a burdensome and time-consuming task.

Such devices are shown in the following U.S. Patents:

| U.S. Pat. No. | Inventor | Date |
|---|---|---|
| 1,073,939 | Spedden | Sept. 23, 1915 |
| 1,723,332 | Day et al. | Aug. 6, 1929 |
| 2,283,493 | Dickinson et al. | May 19, 1942 |
| 2,331,139 | Van Buren | Oct. 5, 1943 |

These patents illustrate the problem referred to above-namely, the burden placed on the operator of readjusting the line guide to a new line, and thus limiting the speed and efficiency of the typist.

The indexing line guide of the present invention reduces the difficulty indicated above, and affords other features and advantages heretofore not obtainable.

SUMMARY OF THE INVENTION

It is among the objects of the present invention to facilitate the repositioning to the next lower line of a line guide for a copy stand.

Another object of the invention is to enable the typist, by the mere tap of a finger, to reposition an indexing line guide to the next lower line of printed matter on a sheet of copy supported on a copy stand.

These and other objects and advantages are accomplished by an indexing line guide adapted to be used on a copy stand having an upright pallet for supporting sheets with horizontal lines of text to be copied. The line guide comprises a guide rail with a row of teeth defining a rack located adjacent a side edge of the pallet and a slide operatively connected to the rail for longitudinal movement therealong, and including a line bar extending horizontally across the pallet parallel to the lines of text. The slide is indexed incrementally, line by line, down the lines of text to be copied by means of an escapement that includes a lever carried by the slide and an upper tooth and a lower tooth alternately engageable with the teeth of the rack at vertically spaced locations.

The escapement means is pivotable in response to actuation of the lever between an operating position wherein one tooth engages the rack and supports the slide, with the line guide in a horizontal position, and an indexing position wherein the escapement is pivoted and indexed downward one line relative to the pallet to disengage the one tooth from the rack and engage the other tooth with the rack teeth until the lever is released, whereupon the one tooth engages the rack teeth at the next lower position.

DESCRIPTION OF THE PREFERRED EMBODIMENT

Figure 1:
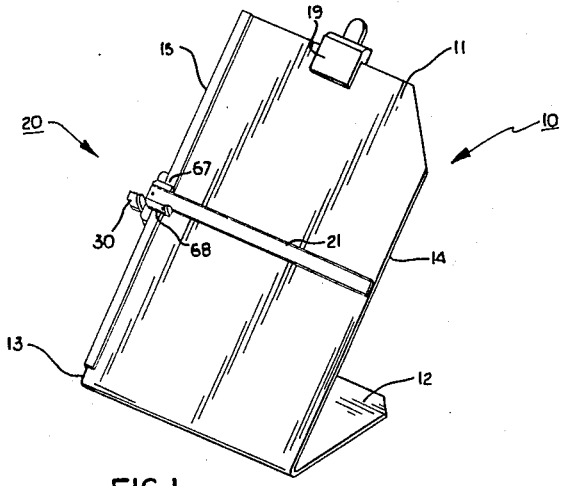
FIG. 1 is a perspective view of a copy stand for supporting sheets of material to be copied and a line guide embodying the invention associated therewith.
Figure 2:
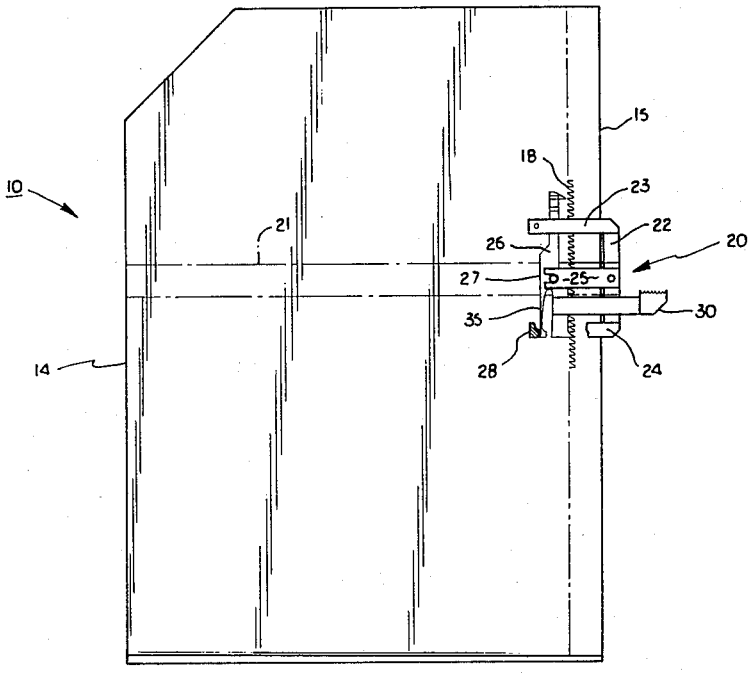
FIG. 2 is an elevational view, showing the back side of the copy board and the indexing mechanism for the line guide.

Referring more particularly to the drawings, and initially to FIGS. 1 and 2, there is shown a copy stand 10 adapted to support a sheet or sheets of copy material with horizontal lines of text to be copied and a slide 20 adapted to travel up and down the left-hand side of the stand. The slide 20 includes a line guide 21 adapted for vertical movement up and down the lines of text to aid a typist or word processor operator in maintaining a visual reference to the particular line of text being copied.

The copy stand 10 has an upright pallet 11 angularly positioned for holding the sheets of printed matter and a supporting base 12 adapted to rest on a desk top or the like. The pallet has left and right side edges 13 and 14 and a grooved guide rail 15 with a row of teeth defining a rack. The guide rail 15 is positioned on the left side edge 13 and the groove 16 receives the edge portion 13. The guide rail 15 is secured to the pallet, such as by adhesive or other means, to place it in a fixed position.

The rail has an outer side edge 17, and opposite that edge, on the rearward side of the pallet, are a row of teeth 18 spaced in correspondence with a standard spacing between vertical lines of text on the sheet to be copied.

The sheets of text may be clamped to the pallet 11 with a standard clip 19, if desired.

The slide 20 is adapted to be slidably retained by the guide rail 15 and to move up and down to a selected position. A line guide 21 carried by the slide 20 extends laterally across the pallet 11, parallel to the lines of text on the sheet to be copied.

Figure 4:
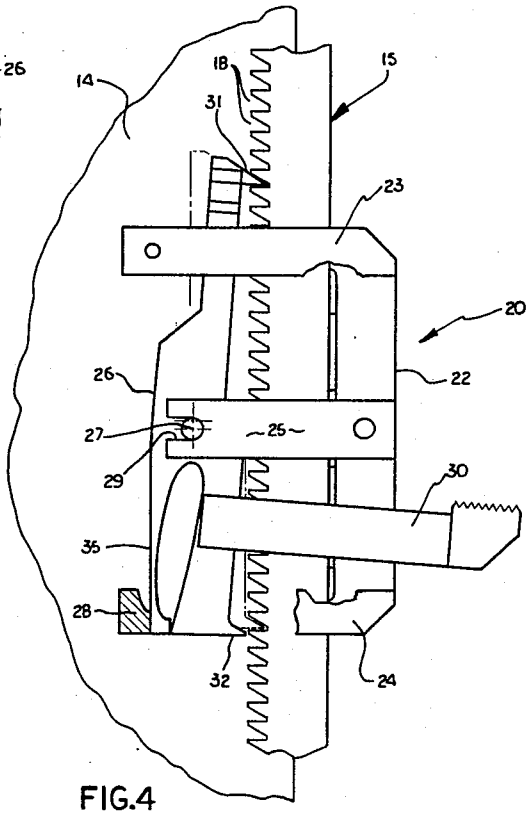
FIG. 4 is a fragmentary, elevational view, on an enlarged scale, with parts broken away and shown in section similar to FIG. 3 but showing the indexing mechanism during the indexing operation.
Figure 10:
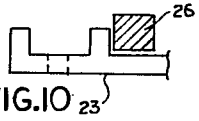
FIG. 10 is a fragmentary sectional view taken on the line 10—10 of FIG. 3.
Figure 3:
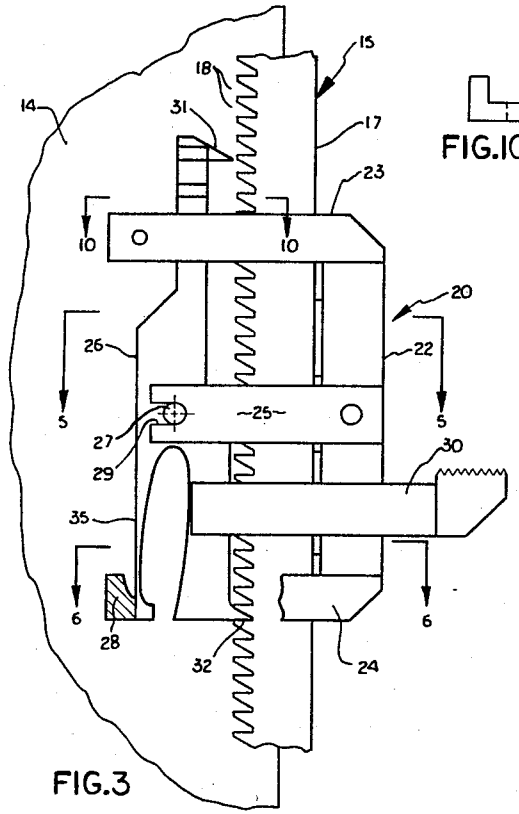
FIG. 3 is a fragmentary, elevational view, on an enlarged scale, with parts broken away and shown in section, illustrating the slide for the line guide and the indexing mechanism associated therewith.

Referring more particularly to FIGS. 3 and 4, the slide 20 has a side bar 22 that is located at the side edge 17 of the guide rail 15 and engages the side edge at its upper and lower ends. Upper and lower beams 23 and 24 extend inwardly from the bar 22 across the back side of the guide rail 15, along with a central arm 25. The front of the slide 20 has an arm 68 that extends over the front of the guide rail 15 and the arm 68 has an outwardly extending post 69.

An escapement 26 is pivotally connected at pivot pin 27 to the bar 22 for pivotal movement in a plane parallel to the surface of the pallet. Also, the pin 27 formed on the escapement is slidably received in a slot 29 formed in the arm 25 so that the escapement is free to move inward relative to the arm 25.

The escapement 26 includes a lever 30 that extends outwardly from the slide 20 and is adapted to be depressed by the operator's finger for the purpose of indexing the line guide 21 to the next lower line of text. The lever 30 extends generally perpendicular to the main body of the escapement, which includes upper and lower teeth 31 and 32 adapted to alternately engage the teeth 18 of the guide rail 15. The lever also has an outwardly extending post 70.

The lever 30 is adapted to pivot the escapement 26 from the engaged position illustrated in FIG. 3 to the indexing position indicated in FIG. 4. When the escapement 26 is in its normal engaged position, the lower tooth 32 is in engagement with the teeth 18 of the guide rail 15, and, by that engagement, supports and retains the slide 20 in a desired fixed, vertical position relative to the pallet 11.

Before using the line guide, the sheet of text material is positioned so that the line guide 21 lies immediately below a line of text. The teeth 18 are so spaced that the distance between them is equal to the vertical line spacing between the lines of text.

When the lever 30 is depressed, using the operator's finger, the escapement 26 moves to the position illustrated in FIG. 4. It should be noted that the escapement is biased to the position illustrated in FIG. 3 by a spring arm 35 formed as an integral part of the escapement 26, and which bears against a tab 28 extending toward the pallet from the lower beam 24.

The pivotal movement of the escapement 26 about the pivot 27 to the position shown in FIG. 4 causes the lower tooth 32 to move out of engagement with the teeth 18 of the rack 15, and at the same time moves the upper tooth 31 into engagement. This pivotal movement also produces a camming effect as the tooth 31 moves into mesh, since the vertical spacing between the teeth 31 and 32 does not provide for simultaneous mesh. This camming action forces the slide 20 slightly downward so that the lower tooth 32 is no longer aligned with the same rack teeth as before. Thus, when the lever 30 is released, the tooth 31 pivots out of engagement with the teeth 18 of the rack, and the tooth 32 moves back into engagement and, at the same time, cams slightly downwardly to a new vertical position relative to the pallet. Thus, the line guide 21 is brought to a new position underneath the next lower line of text on the sheet to be copied.

Figure 5:
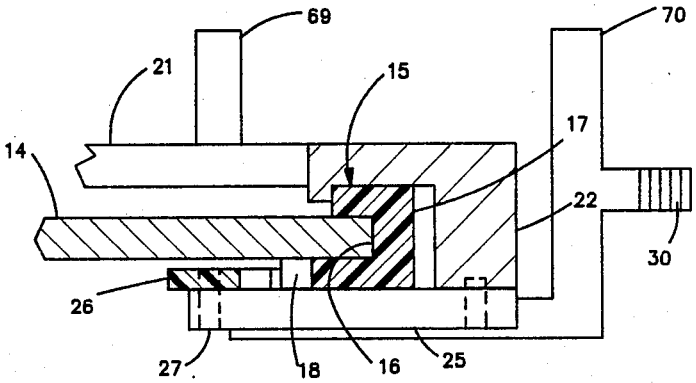
FIG. 5 is a fragmentary, sectional view on an enlarged scale, taken on the line 5—5 of FIG. 3.
Figure 6:
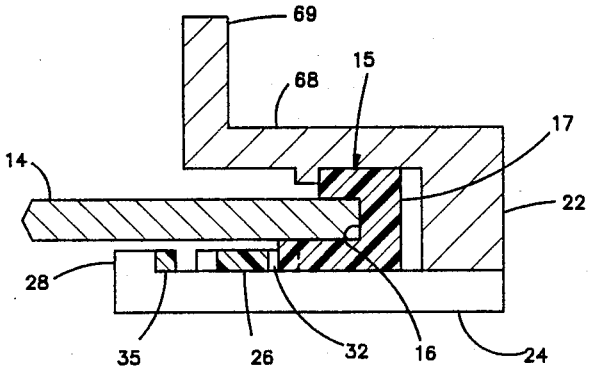
FIG. 6 is a fragmentary, sectional view on an enlarged scale, taken on the line 6—6 of FIG. 3.

When the escapement 26 is pressed inward (see FIG. 5) by exerting a pinching force between arm 69 (which is rigidly attached to arm 68) and arm 70 (an integral part of the lever 30), tooth 32 is disengaged from the rack 15 without re-engaging tooth 31. Thus, the slide is free to be moved quickly along the guide rail 15 to any desired position.

The guide rail 15 is interchangeable with other guide rails with different spacing between the rack teeth. Thus, different guide rails may be used to accommodate text with different vertical spacing between lines.

Figure 7:
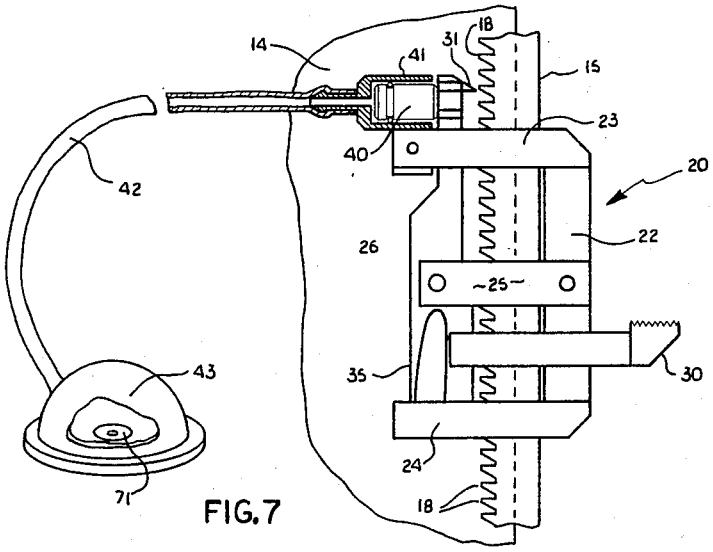
FIG. 7 is a fragmentary, elevational view of the slide and indexing mechanism similar to FIGS. 3 and 4 but showing, partly in diagrammatic form, an alternate means (pedal-operated air pressure) for actuating the indexing mechanism.

FIG. 7 illustrates an additional feature of the invention which permits the escapement 26 to be actuated by the typist's foot, using an air pressure system. In this arrangement, a plunger 40 is located adjacent the tooth 31, and the cylinder 41 for the plunger 40 is fixed to the bar 23. An air line 42 extends from the cylinder 41 to an actuator bulb 43 located on the floor. Accordingly, when the operator presses the bulb with his or her foot, the air pressure forces the plunger 40 forward to pivot the escapement, and thus move the tooth 31 into the rack teeth 18. Thus, the slide 20 indexes down one increment, as in the case of where the lever is operated by the operator's finger. A check valve 71 is located in the actuator bulb 43 and provides makeup air to account for any loss of air around the plunger 40.

Figure 8:
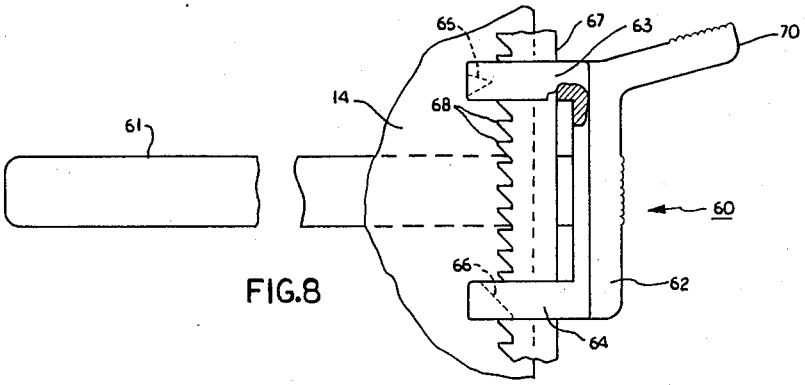
FIG. 8 is a fragmentary, elevational view, in broken form for the purpose of illustration, showing a modified form of the indexing mechanism of the invention.

FIG. 8 shows a modified form of the invention, wherein the pivotal connection between the slide and the escapement is eliminated, and one rigid element 60 serves both functions. In this situation, the lever 70 is rigidly attached to the slide 60, which includes arms 63 and 64 that carry the teeth 65 and 66. The line guide 61 is connected as before to a vertical side bar 62 forming part of the slide 60.

With this arrangement, when the lever 70 is depressed, the entire rigid slide 60 pivots to bring the upper tooth 65 into engagement with the rack teeth 68 and also produces a camming action. Additional pivotal movement pulls the lower tooth 66 out of engagement, after which it slips downwardly a sufficient distance that when the lever is released, the lower tooth engages in the next lower increment to reposition the line guide 61 in the next lower line of printed text.

It will be noted that there is no means biasing the slide to its normal operating position other than the weight of the line guide acting in cantilever fashion upon the slide.

Figure 9:
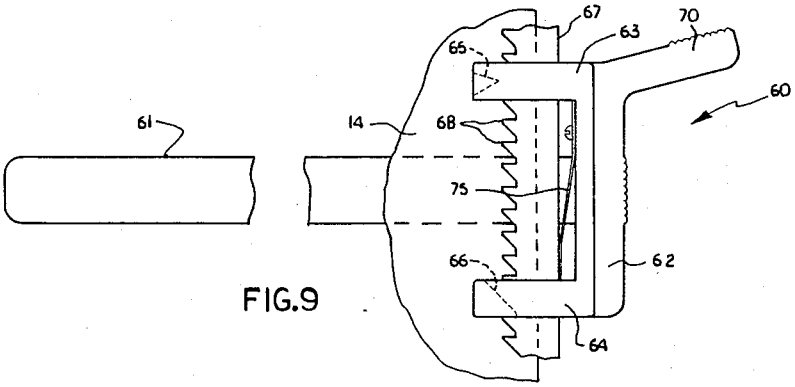
FIG. 9 is a fragmentary, elevational view similar to FIG. 8, in broken form, showing still another modified form of the indexing mechanism of the invention.

FIG. 9 shows a variation of the modification shown in FIG. 8, wherein a spring arm 75 is added to bias the slide/escapement against disengagement. Otherwise, the indexing mechanism of FIG. 9 operates in the same manner as that shown in FIG. 8.

While the invention has been shown and described with respect to particular embodiments thereof, this is for the purpose of illustration rather than limitation, and other variations and modifications of the specific embodiments herein shown and described will be apparent to those skilled in the art all within the intended spirit and scope of the invention. Accordingly, the patent is not to be limited in scope and effect to the specific embodiments herein shown and described nor in any other manner that is inconsistent with the extent to which the progress in the art has been advanced by the invention.

What is claimed is:

1. An indexing line guide for a copy stand having an upright pallet with a front face and back face for supporting on its front face sheets with horizontal lines of text to be copied, comprising:

a guide rail with a row of rack teeth located adjacent a side edge of said pallet and on the back face thereof; said row of rack teeth facing laterally toward the opposite side edge of said pallet;

a slide operatively connected to said rail for longitudinal movement therealong, and including a line guide extending horizontally across the front face of the pallet parallel to the lines of text;

an escapement means in said slide including:

a lever pivotally mounted to said slide and pivotable in a plane parallel to the faces of said pallet and having one arm extending laterally outward beyond said side edge of said pallet; and an upper tooth and a lower tooth located on another arm of said lever adjacent the back face of said pallet and being alternately engageable with the rack teeth at vertically spaced locations;

said means being pivotable in response to actuation of said lever between an operating position wherein one tooth engages said rack teeth and supports said slide with said line guide in a horizontal position and with the other tooth disengaged from said rack teeth, and an indexing position wherein said means is pivoted relative to said pallet to disengage said one tooth from said rack teeth and engage the other tooth with said rack teeth until said lever is released, whereupon said one tooth engages the rack teeth at a lower position.

2. An indexing line guide as defined in claim 1, including resilient means biasing said escapement means to said operating position.

3. An indexing line guide as defined in claim 2, wherein said resilient means comprises a leaf spring secured to said slide and adapted to bear between said slide and said guide rail.

4. An indexing line guide as defined in claim 1, wherein said slide comprises a main body guided for sliding movement along said guide rail and wherein said escapement means comprises a separate articulated element pivotally connected to said main body.

5. An indexing line guide as defined in claim 4, including resilient means biasing said separate articulated element to said operating position.

6. An indexing line guide as defined in claim 5, wherein said resilient means comprises a leaf spring formed integrally with said separate articulated element and adapted to bear between said main body of said slide and said articulated element.

* * * * *